US009404267B2

(12) United States Patent
Nichols

(10) Patent No.: US 9,404,267 B2
(45) Date of Patent: Aug. 2, 2016

(54) INTERCHANGEABLE GUTTER CLEANING APPLIANCE

(71) Applicant: Timothy S. Nichols, Huntersville, NC (US)

(72) Inventor: Timothy S. Nichols, Huntersville, NC (US)

( * ) Notice: Subject to any disclaimer, the term of this patent is extended or adjusted under 35 U.S.C. 154(b) by 58 days.

(21) Appl. No.: 14/313,983

(22) Filed: Jun. 24, 2014

(65) Prior Publication Data

US 2015/0368905 A1 Dec. 24, 2015

(51) Int. Cl.
*E04D 13/076* (2006.01)
*B25G 3/38* (2006.01)

(52) U.S. Cl.
CPC ..... *E04D 13/0765* (2013.01); *B25G 3/38* (2013.01)

(58) Field of Classification Search
CPC ..... E04D 13/0765; B25G 1/00; B25G 1/04; B25G 3/00; B25G 3/02; B25G 3/04; B25G 3/10; B25G 3/12; B25G 3/20; B25G 3/22; B25G 3/24; B25G 3/28; B25G 3/38
USPC ..... 15/236.04, 144.1, 144.4, 145, 146, 144, 15/3; 401/289; 294/24, 49–181
See application file for complete search history.

(56) References Cited

U.S. PATENT DOCUMENTS

| | | | | |
|---|---|---|---|---|
| 285,594 | A | 8/1883 | Elliott | |
| 1,131,863 | A * | 3/1915 | Phillips | A46B 7/04 15/145 |
| 1,939,475 | A | 12/1933 | Walsh | |
| 2,004,576 | A | 6/1935 | Kirsch | |
| 2,234,761 | A | 3/1941 | Harpootlian | |
| 2,280,778 | A | 4/1942 | Andersen | |
| 2,520,863 | A | 8/1950 | Thomas et al. | |
| 2,591,530 | A | 4/1952 | Findley et al. | |
| 2,605,136 | A | 7/1952 | Kline et al. | |
| 2,684,497 | A | 7/1954 | Graham | |
| 2,720,409 | A | 10/1955 | Griffith | |
| 2,817,867 | A * | 12/1957 | Bugbird | A47L 13/24 15/144.4 |
| 2,896,239 | A | 7/1959 | Bugbird | |
| 2,910,711 | A | 11/1959 | Mizelle | |
| 3,601,835 | A | 8/1971 | Morgan | |
| 3,687,493 | A | 8/1972 | Lock et al. | |
| 3,743,339 | A | 7/1973 | Brackett | |
| 3,858,267 | A | 1/1975 | Swannie | |
| 3,894,807 | A * | 7/1975 | Betz, III | B05C 17/0205 15/145 |
| 3,972,552 | A | 8/1976 | Earp, Jr. | |
| 4,057,276 | A | 11/1977 | Currie | |

(Continued)

FOREIGN PATENT DOCUMENTS

| | | | |
|---|---|---|---|
| DE | 9201966 | * | 8/1992 |
| EP | 1318249 | * | 6/2003 |

(Continued)

*Primary Examiner* — Mark Spisich
(74) *Attorney, Agent, or Firm* — James D. Wright; David R. Higgins; Tillman Wright, PLLC

(57) ABSTRACT

An interchangeable gutter cleaning appliance includes an extension assembly having a first fitting at a distal end, a holder having a second fitting at its proximal end and a gutter tool interface at its distal end, and an interchangeable gutter tool. The second fitting is coupled to the first fitting of the extension assembly. The interchangeable gutter tool is installed on the gutter tool interface by inserting the gutter tool interface into a mounting assembly in the interchangeable gutter tool, and the interchangeable gutter tool is removed from the gutter tool interface by removing the mounting assembly from the gutter tool interface.

15 Claims, 16 Drawing Sheets

(56) References Cited

U.S. PATENT DOCUMENTS

| | | | |
|---|---|---|---|
| 4,114,938 | A | 9/1978 | Strader |
| 4,150,793 | A | 4/1979 | Russo |
| 4,191,792 | A | 3/1980 | Janssen |
| 4,196,927 | A | 4/1980 | Lomaga |
| 4,310,940 | A | 1/1982 | Moore |
| 4,319,851 | A | 3/1982 | Arthur |
| 4,349,039 | A | 9/1982 | Egger |
| 4,363,335 | A | 12/1982 | Tapper |
| 4,447,927 | A | 5/1984 | Malless, Jr. |
| 4,502,806 | A | 3/1985 | Albertson |
| 4,750,883 | A | 6/1988 | Drake |
| 4,848,818 | A | 7/1989 | Smith |
| 4,930,824 | A | 6/1990 | Matthews et al. |
| 5,022,586 | A | 6/1991 | Putnam |
| 5,037,028 | A | 8/1991 | Evans |
| 5,386,942 | A | 2/1995 | Dietle |
| 5,390,853 | A | 2/1995 | Ellul |
| D369,962 | S | 5/1996 | Moore |
| 5,573,024 | A | 11/1996 | DeVaney et al. |
| D392,781 | S | 3/1998 | McKnight |
| 5,725,322 | A | 3/1998 | Evans |
| 5,727,580 | A | 3/1998 | Patterson |
| 5,769,324 | A | 6/1998 | Lenhart |
| 5,810,408 | A | 9/1998 | Armstrong |
| 5,853,209 | A | 12/1998 | McDermott |
| 5,988,715 | A | 11/1999 | Mason |
| 6,209,937 | B1 | 4/2001 | Keiter |
| 6,315,341 | B1 | 11/2001 | Leon et al. |
| 6,378,153 | B1 | 4/2002 | Morgan |
| D463,961 | S | 10/2002 | Hoshyla |
| 6,925,676 | B2 | 8/2005 | Heavner et al. |
| 6,941,610 | B2 | 9/2005 | Reed, Jr. |
| 6,945,577 | B1 | 9/2005 | Scott |
| 7,120,963 | B2 | 10/2006 | Kim |
| 8,016,733 | B2 | 9/2011 | Kim |
| 2003/0051305 | A1 | 3/2003 | Hewlett |
| 2005/0034261 | A1 | 2/2005 | Capoccia |
| 2005/0278885 | A1 | 12/2005 | Sauer |
| 2006/0207044 | A1* | 9/2006 | Ridgway ..... A46B 5/0091 15/146 |
| 2009/0255076 | A1* | 10/2009 | Bagley ..... A46B 5/02 15/145 |
| 2012/0071308 | A1 | 3/2012 | Sekar |

FOREIGN PATENT DOCUMENTS

| | | | |
|---|---|---|---|
| GB | 1418462 | * | 12/1975 |
| GB | 2030849 | * | 4/1980 |
| GB | 2370755 | * | 7/2002 |
| WO | 84/02553 | * | 7/1984 |
| WO | 2008053195 | A1 | 5/2008 |
| WO | 2012040213 | A1 | 3/2012 |

* cited by examiner

INTERCHANGEABLE GUTTER CLEANING APPLIANCE

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

1. Field of the Present Invention

The present invention relates generally to gutter cleaning tools, and, in particular, to a gutter cleaning appliance to which various gutter cleaning tools may be interchangeable and removably mounted.

2. Background

Removing build-up and sediment of leaves, sticks, shingle particles and other residue from overhead gutters on the eaves of homes and other buildings has heretofore been a dangerous, tiresome, filthy and time-consuming job. Homeowners and professionals have typically attempted to perform this task by standing on a ladder or other elevated apparatus, or climbing onto the roof and balancing precariously near the edge while reaching down in the gutter. Unfortunately, these techniques are dangerous, and are made even more dangerous when trying to utilize many of the implements that are pressed into service in the chore, including various cleaning tools, water hoses, gas and electric blowers, and the like. In fact, according to one source, over 400,000 injuries occur every year due to falls from roofs and ladders.

Unfortunately, most gutters are only partly accessible from the ground, if at all. While the prior art includes a number of efforts to permit the user to clean out the gutters while standing on the ground, such as by using long poles equipped with cumbersome water delivery hoses and other devices, such prior devices have suffered from a number of drawbacks which have limited their commercial viability, practicality and usability. Thus, a need exists for an improved gutter cleaning appliance.

SUMMARY OF THE PRESENT INVENTION

Broadly defined, the present invention according to one aspect includes is an interchangeable gutter cleaning appliance, including: an extension assembly having a first fitting at a distal end; a holder having a second fitting at its proximal end and a gutter tool interface at its distal end, wherein the second fitting is coupled to the first fitting of the extension assembly; and an interchangeable gutter tool; wherein the interchangeable gutter tool is installed on the gutter tool interface by inserting the gutter tool interface into a mounting assembly disposed within the interchangeable gutter tool, and wherein the interchangeable gutter tool is removed from the gutter tool interface by removing the mounting assembly from the gutter tool interface.

In a feature of this aspect, the interchangeable gutter tool includes a plurality of interchangeable gutter tools, each including a different operational member, and no more than one of the plurality of interchangeable gutter tools being installed on the gutter tool interface at any one time. In further features, the plurality of interchangeable gutter tools include at least two of the following: a scoop, a rake, a brush, and a water sprayer; and/or the plurality of interchangeable gutter tools are provided as a kit with the holder and the extension assembly.

In another feature of this aspect, the interchangeable gutter tool includes a mounting arm in which the mounting assembly is disposed. In further features, the mounting assembly includes a cartridge surrounded by a compressible layer of soft material; the cartridge includes a hollow cylindrical tube having a fixed entry sleeve and a floating internal sleeve disposed therein; the gutter tool interface includes a rod that is inserted into fixed entry sleeve and the floating internal sleeve; the floating internal sleeve clamps around the rod, and the hollow cylindrical tube, compressible layer of soft material, and operational arm are free to rotate around the floating internal sleeve and rod; the rod is a forged metal rod; the compressible layer of soft material is a layer of foam; the mounting assembly is a paint roller cover; and/or the holder is a paint roller holder.

In another feature of this aspect, the interchangeable gutter tool includes a water sprayer supported by the mounting assembly. In a further feature, the water sprayer includes a nozzle and a hose fitting.

In another feature of this aspect, the interchangeable gutter tool is free to rotate around the gutter tool interface when installed thereon. In a further feature, the gutter tool interface has a longitudinal axis, the interchangeable gutter tool includes an operational member whose center of gravity is not collinear with the longitudinal axis of the gutter tool interface, and the interchangeable gutter tool rotates such that it hangs below the gutter tool interface as the interchangeable gutter cleaning appliance is moved.

In another feature of this aspect, the extension assembly includes a plurality of pull-out sections that may be manipulated relative to each other so as to adjust the overall length of the extension assembly and thus of the interchangeable gutter cleaning appliance. In a further feature, the first and second fittings are threaded fittings.

Broadly defined, the present invention according to another aspect is a method of cleaning a gutter, including: fastening an extension assembly to a tool holder by coupling a fitting at a distal end of the extension assembly to a corresponding fitting at a proximal end of the tool holder; procuring a plurality of different, removable, interchangeable gutter tools for use with the tool holder, each having a mounting assembly disposed therein; selecting a particular removable, interchangeable gutter tool from the plurality of different, removable, interchangeable gutter tools; installing the selected removable, interchangeable gutter tool on a gutter tool interface located at a distal end of the tool holder by inserting the gutter tool interface into the mounting assembly of the selected interchangeable gutter tool; and while standing on the ground, manipulating the extension assembly to cause the selected removable, interchangeable gutter tool to carry out a task of removing debris from a gutter located overhead.

In a feature of this aspect, the selected removable, interchangeable gutter tool is a first removable, interchangeable gutter tool, and the method further includes: removing the first removable, interchangeable gutter tool from the gutter tool interface; selecting a second particular removable, interchangeable gutter tool from the plurality of different, removable, interchangeable gutter tools; after removing the first removable, interchangeable gutter tool from the gutter tool interface, installing the second selected removable, interchangeable gutter tool on the gutter tool interface by inserting the gutter tool interface into the mounting assembly of the second selected interchangeable gutter tool; and while standing on the ground, manipulating the extension assembly to cause the second selected removable, interchangeable gutter tool to carry out a task of removing debris from the gutter.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
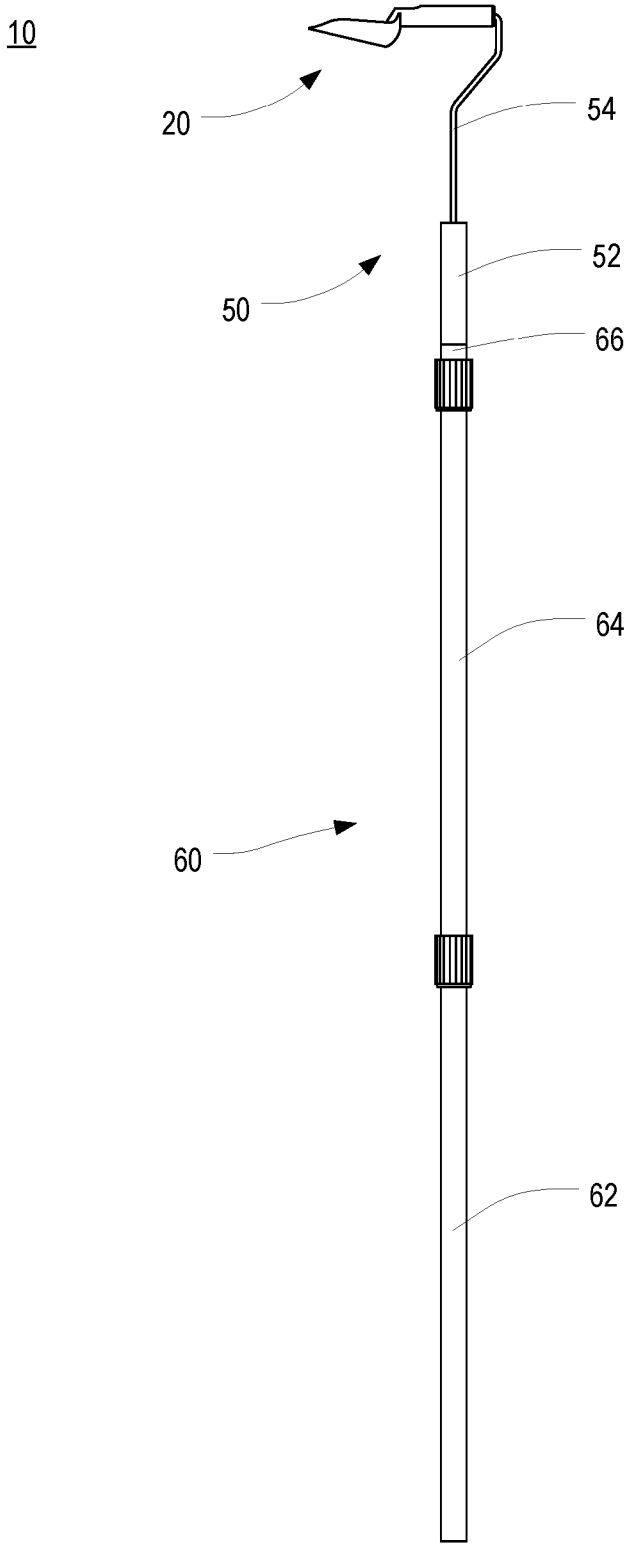
FIG. 1 is front view of an interchangeable gutter cleaning appliance in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiments is merely exemplary in nature and is in no way intended to limit the invention, its implementations, or uses.

FIG. 1 is front view of an interchangeable gutter cleaning appliance 10 in accordance with one or more preferred embodiments of the present invention. As shown therein, the appliance 10 includes an interchangeable gutter tool 20, a holder 50, and an extension assembly 60. The holder 50 is supported at an upper end of the extension assembly 60, and the interchangeable gutter tool 20 is supported at a distal end of the holder 50.

Figure 2:
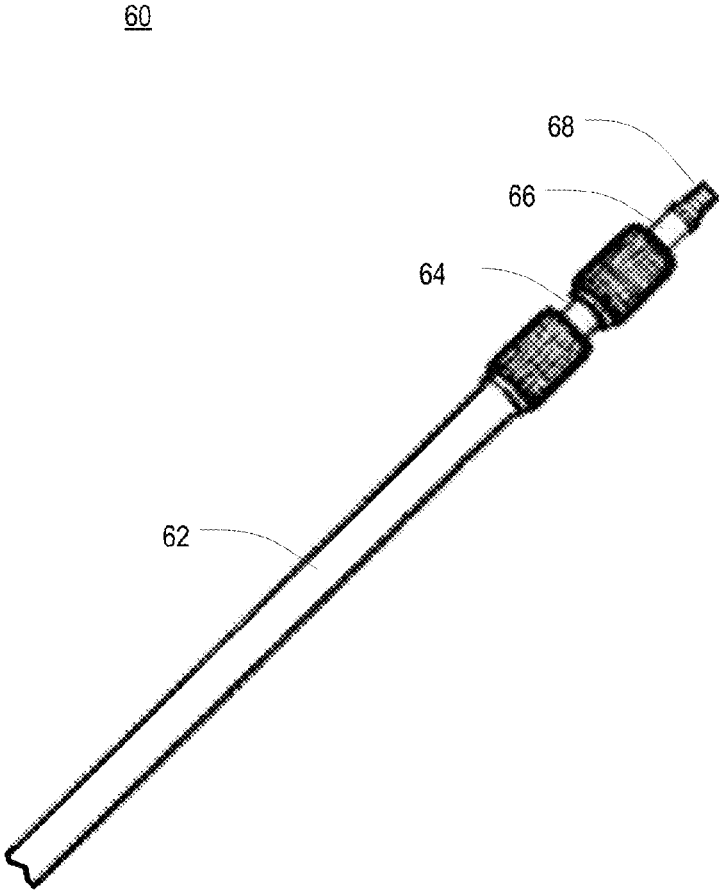
FIG. 2 is a fragmentary perspective view of a portion of the extension assembly of FIG. 1, shown in its collapsed state.

FIG. 2 is a fragmentary perspective view of a portion of the extension assembly 60 of FIG. 1, shown in its collapsed state. As shown therein, the extension assembly 60 includes a plurality of telescoping and locking extension members 62,64,66 with a fitting 68 at the distal end of the uppermost extension member 66 to mate with a corresponding fitting 58 at the proximal end of the holder 50. The extension assembly 60 may comprise any suitable pole or apparatus available from a wide number of commercial outlets, but preferably takes the form of a standard single, two piece, three piece, or four piece, and so forth, telescoping and locking pole having a threaded fitting 68 at its uppermost tip, commonly used and known as a painter's pole. The extension assembly 60 shown in FIGS. 1 and 2 has three pull-out sections 62,64,66 that may be quickly and easily locked in a selected degree of extension by simply rotating the extended portion in a clockwise direction relative to the receiving portion. Such extension assembly 60 may be collapsed to a shorter length by simply rotating the extended sections in a counterclockwise direction and telescoping the sections 62,64,66 one within the other. In its collapsed state, such an extension assembly 60 may, for example, be approximately five feet long, while in its extended state, such an extension assembly may, for example, be approximately fourteen feet long. Extension assemblies suitable for use in one or more preferred embodiments of the present invention are available from Mr. LongArm Inc. of Greenwood, Mo. or Bayco Industries of Dallas, Tex.

Although not illustrated in the drawings, it is acknowledged that additional locks could be provided in connection with such pole or other extension assembly for the purpose of preventing the extended sections from rotating and unlocking during use of the gutter cleaning appliance 10. Such pressure support locks may take the form, for example, of suitable structures positioned and aligned in the pole sections to secure and reach at all times in an infinite number of lengths.

Figure 3:
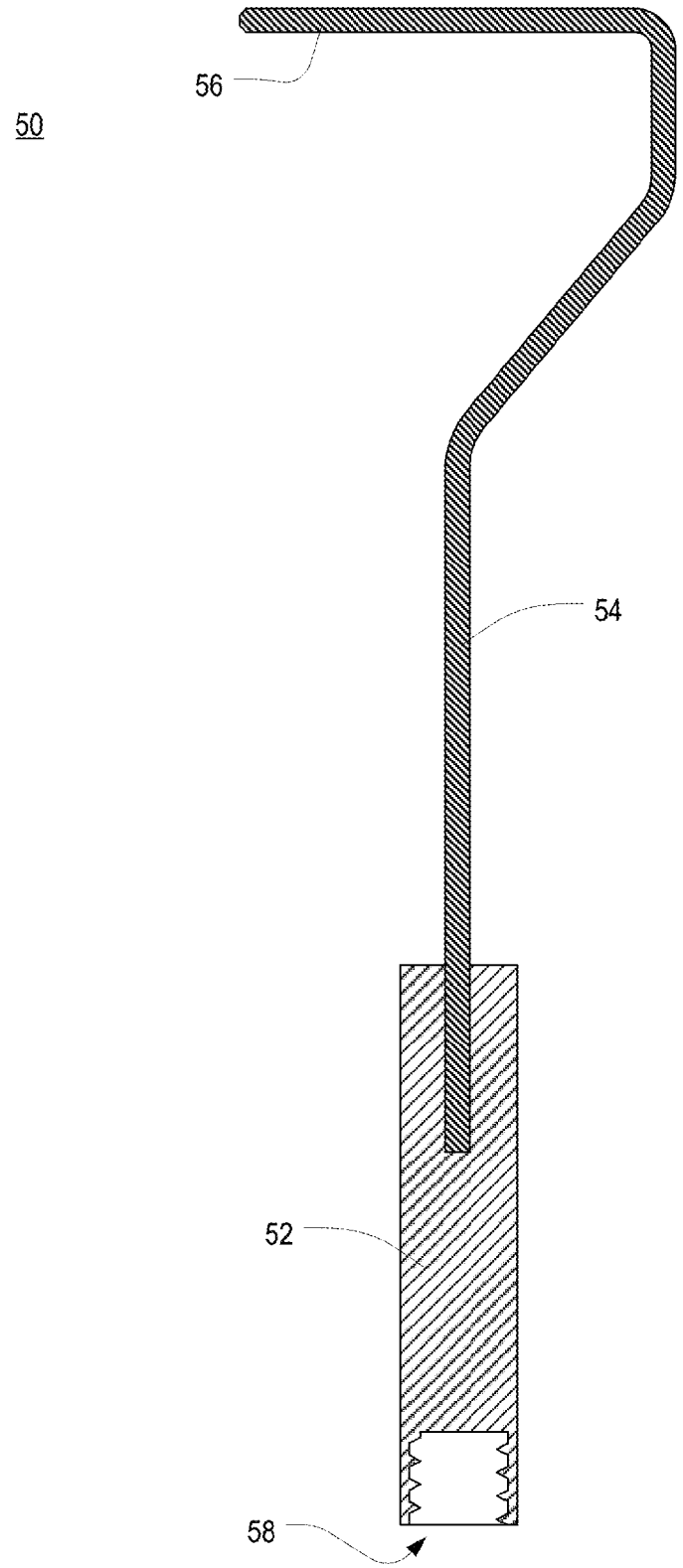
FIG. 3 is a front cross-sectional view of the holder of FIG. 1, shown in isolation.

FIG. 3 is a front cross-sectional view of the holder 50 of FIG. 1, shown in isolation. As shown therein, the holder 50 includes a frame 54 supported by a handle 52. In at least some embodiments, the handle 52 includes a fitting 58 at its proximal end that is adapted to mate with the fitting at the distal end of the extension assembly 60 as described previously. In at least some such embodiments, the fittings 58,68 include complementary threads. Also in at least some such embodiments, the handle fitting 58 is a female fitting and the extension assembly fitting 68 is a male fitting.

At its distal end, the frame 54 includes a tool interface 56 that is adapted to receive and hold the interchangeable gutter tool 20. In at least some embodiments, the tool interface 56 is a cylindrical forged metal roller pin or axle of the type utilized in a conventional paint roller, but in other embodiments the tool interface 56 may take on other forms or be manufactured from other materials.

Figure 4:
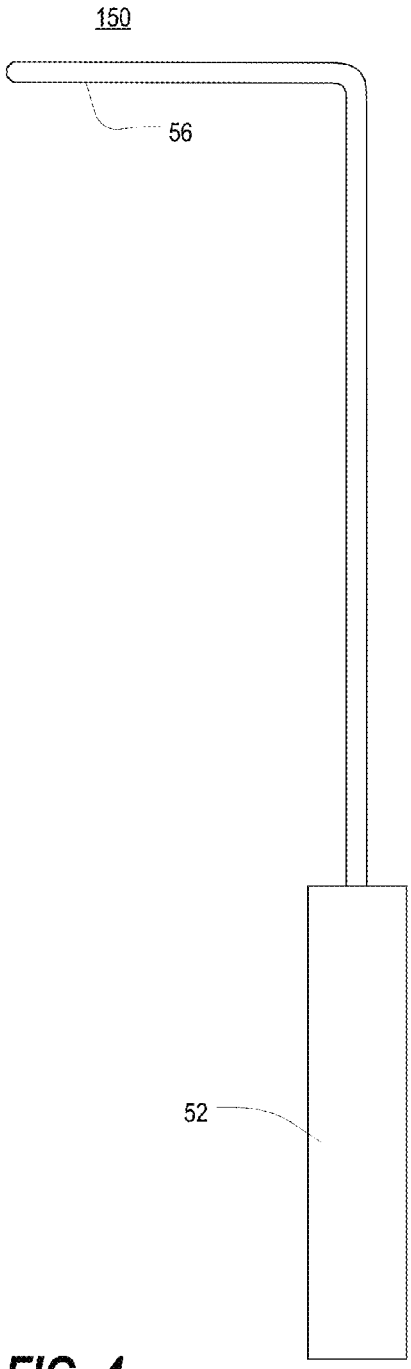
FIGS. 4 and 5 are front views of two alternative holders in accordance with alternative preferred embodiments of the present invention.
Figure 5:
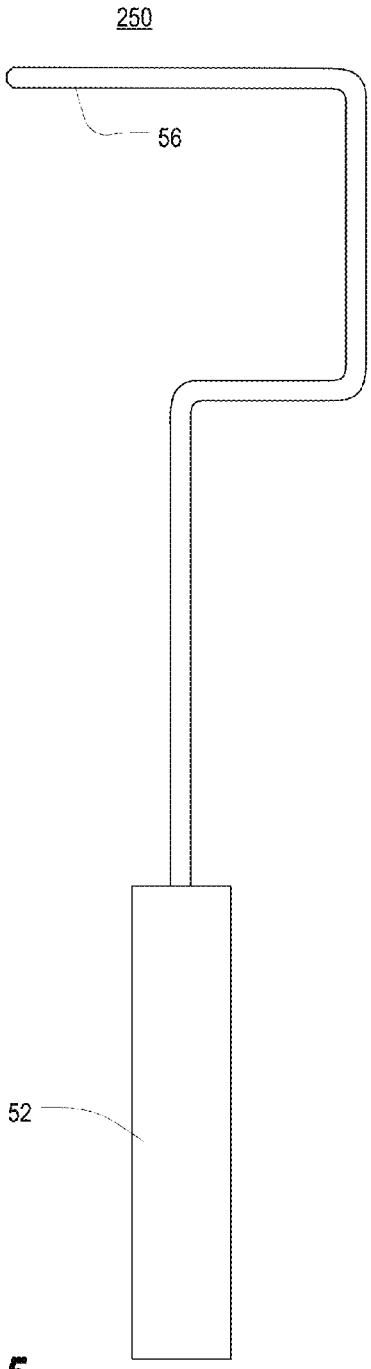

Notably, in the illustrated embodiments, the frame 54 is produced from a single cylindrical rod to which one or more turns or angles are applied. For example, in the frame 54 of FIG. 3, such a rod extends vertically from the handle 52, turns to the right at a 45-degree angle, turns vertical again via another 45-degree angle, and finally turns to the left at a 90-degree angle. However, in other embodiments, the rod might utilize different arrangements of bends. For example, FIGS. 4 and 5 are front views of two alternative holders 150,250 in accordance with alternative preferred embodiments of the present invention.

Figure 6:
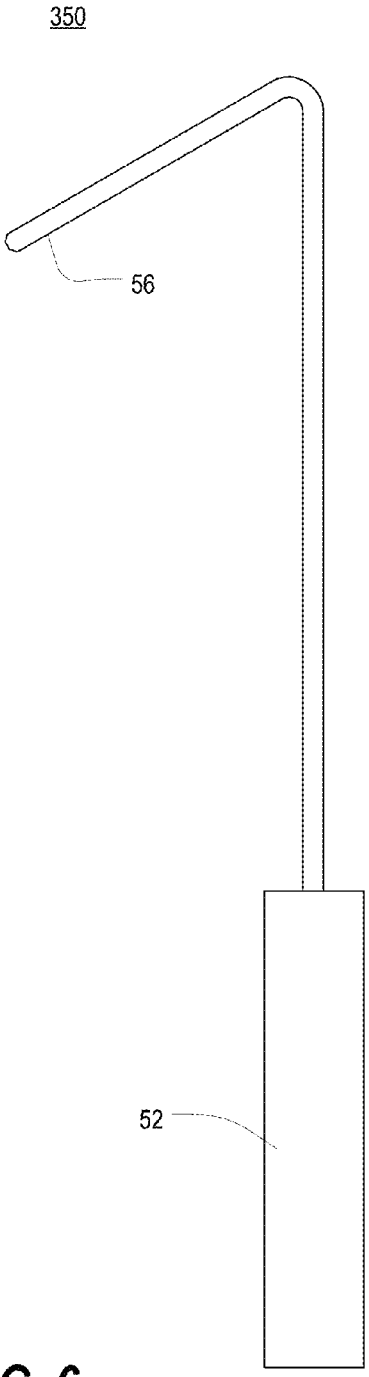
FIGS. 6 and 7 are front views of two alternative holders in accordance with alternative preferred embodiments of the present invention.
Figure 7:
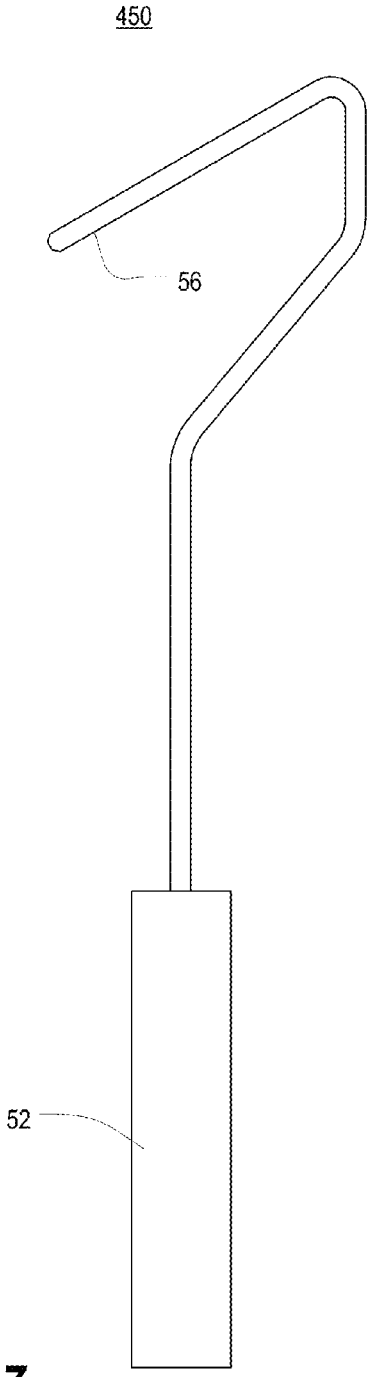

The tool interface 56 is arranged to hold the interchangeable gutter tool 20 at an angle relative to the axis of the handle 52 and/or relative to the axis of the extension assembly 60. In particular, in some embodiments, the tool interface 56 is arranged to hold the interchangeable gutter tool 20 at a 90-degree angle relative to one or both of the aforementioned axes, while in other embodiments, the tool interface 56 is arranged to hold the interchangeable gutter tool 20 at an acute angle relative to one or both of the aforementioned axes. For example, FIGS. 6 and 7 are front views of two alternative holders 350,450 in accordance with alternative preferred embodiments of the present invention. The angle of the tool interface 56 and thus the gutter tool 20 provides an appropriate angle of attack for dislodging and removing build-up, sediment of leaves, sticks, shingle particles, and other debris and materials from a gutter, as will be further described elsewhere herein.

In still other embodiments, the frame itself may be a straight member (i.e., with no turns or angles) extending from a side of the handle, or the handle may itself include one or more turns or angles, and/or the like. It will also be appreciated that, as shown in FIG. 3, the holder 50 may be constructed identically to the holder of a paint roller because of the convenience of an existing supply of holders or the ease of adoption of manufacturing techniques for same, but that alternative constructions may likewise be utilized.

Figure 8:
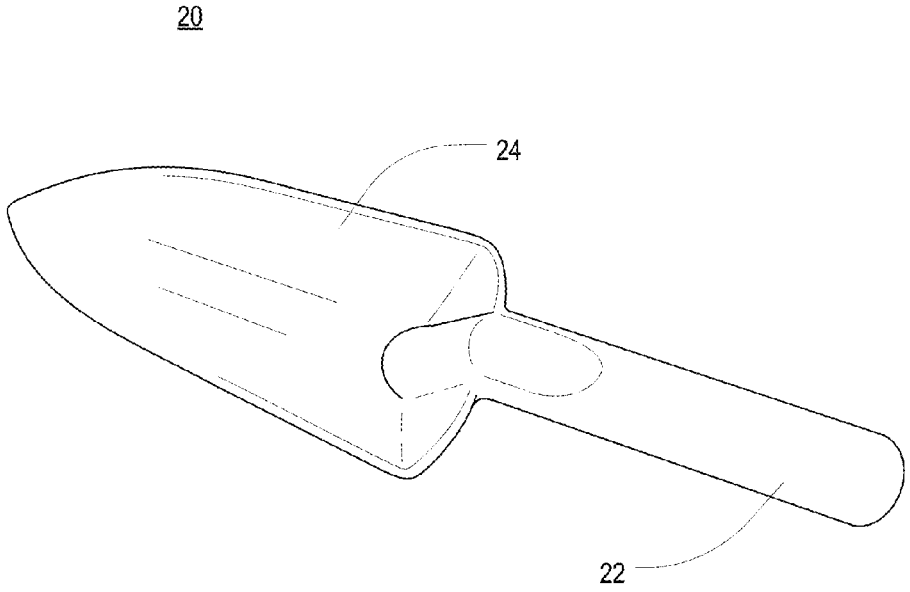
FIG. 8 is a perspective view of the interchangeable gutter tool of FIG. 1.
Figure 9:
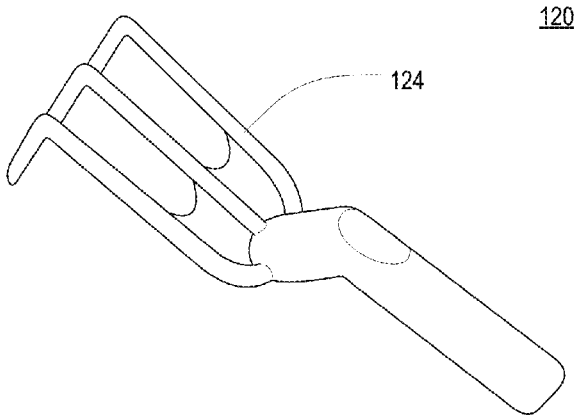
FIG. 9 is a perspective view of an interchangeable gutter tool in which the operational member is a tined rake.
Figure 10:
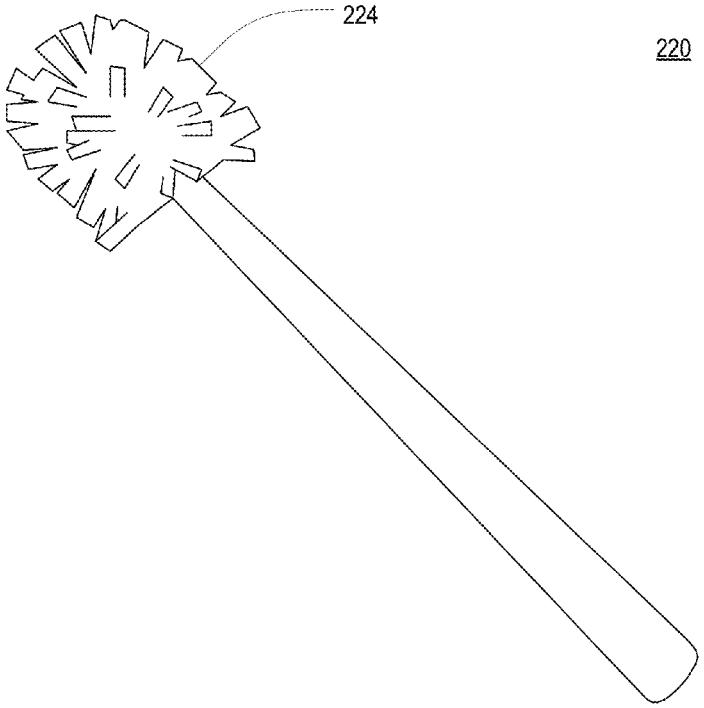
FIG. 10 is a perspective view of an interchangeable gutter tool in which the operational member is a multi-directional stiff-bristled brush.
Figure 11:
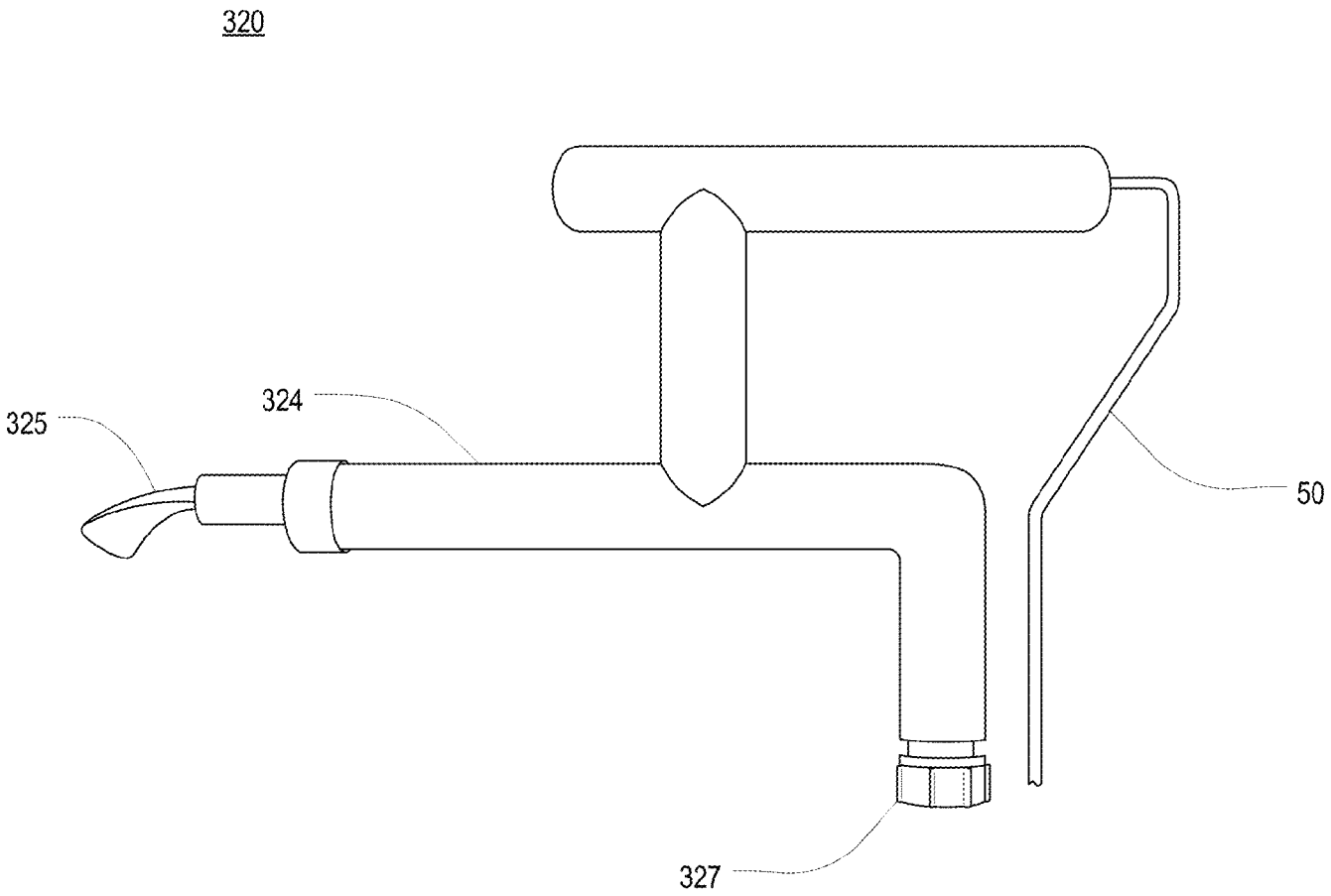
FIG. 11 is a side view of an interchangeable gutter tool (shown mounted on the holder) in which the operational member includes a water sprayer having an input fitting suitable for connection to a standard garden hose.

FIG. 8 is a perspective view of the interchangeable gutter tool 20 of FIG. 1. The gutter tool 20 includes a mounting arm 22 and an operational member 24. In FIG. 8, the operational member 24 is a trowel, but it will be appreciated that other types of operational members may be utilized and, in fact, that in at least some embodiments a variety of different gutter tools 20,120,220,320, each having a different operational member 24,124,224,324, may be substituted for each other by a user 90, all while using the same holder 50. In this regard, FIG. 9 is a perspective view of an interchangeable gutter tool 120 in which the operational member 124 is a tined rake, FIG. 10 is a perspective view of an interchangeable gutter tool 220 in which the operational member 224 is a multi-directional stiff-bristled brush, and FIG. 11 is a side view of an interchangeable gutter tool 320 (shown mounted on the holder 50) in which the operational member 324 is a water sprayer that includes a nozzle 325 and an input fitting 327 suitable for connection to a standard garden hose (not shown). Other operational members may include scoops, garden shovels, spades, and other devices. In at least some embodiments, all or portions of such devices are constructed of synthetic resinous material, such as polyvinyl, polystyrene, or epoxy resins, but in some embodiments, metal, wood, or other materials may be used.

Figure 12:
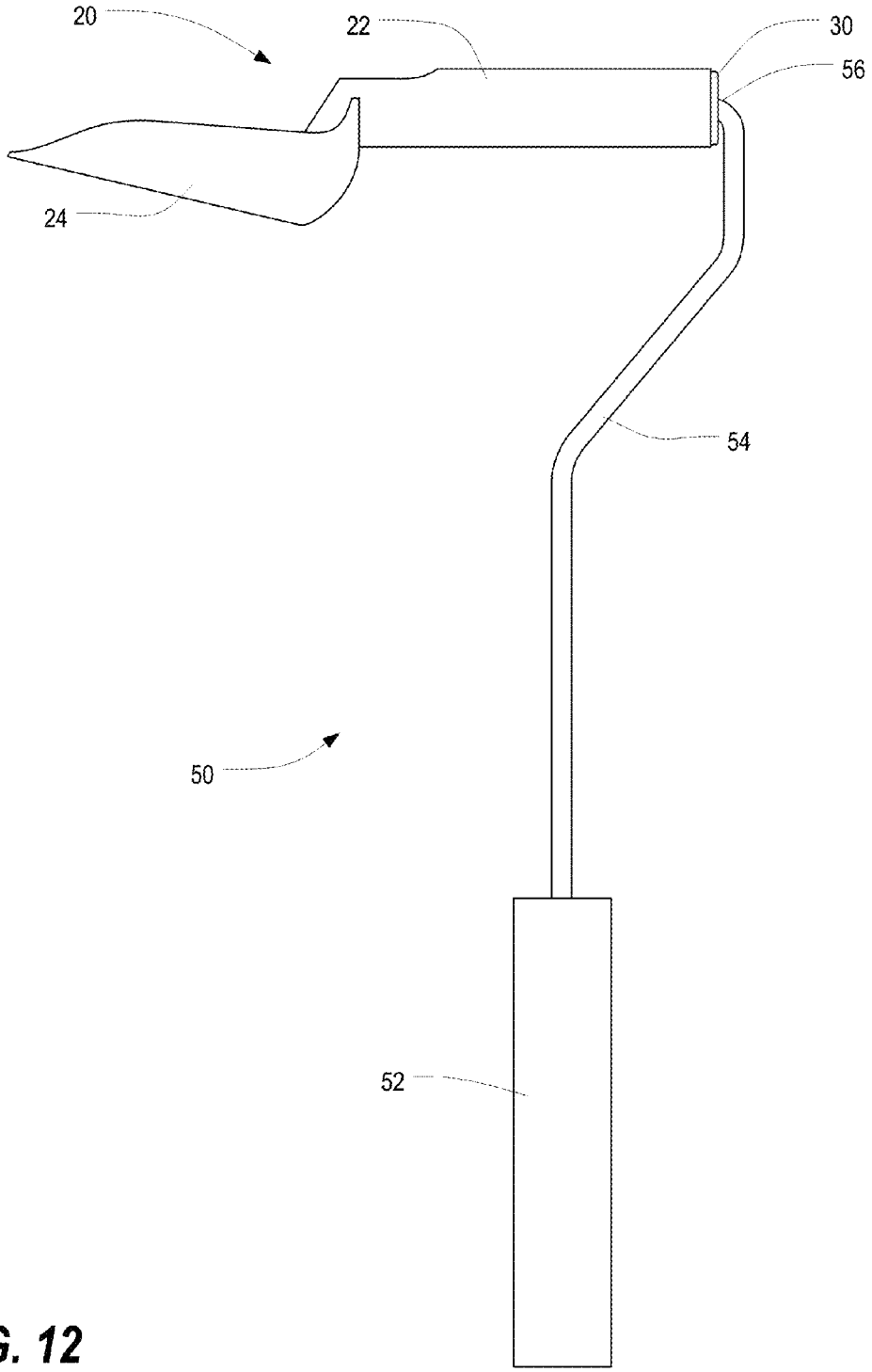
FIG. 12 is an enlarged front view of the interchangeable gutter tool and holder of FIG. 1.

FIG. 12 is an enlarged front view of the interchangeable gutter tool 20 and holder 50 of FIG. 1. The interchangeable gutter tool 20 is mounted on the holder 50 by inserting the tool interface 56 of the holder into the mounting arm 22 of the tool 20. If another tool 120,220,320 is to be used instead of the trowel tool 20, such tool may be mounted on the holder 50 in the same way. In fact, in at least some embodiments one such tool may be removed from the holder 50 and replaced with another tool.

Figure 13:
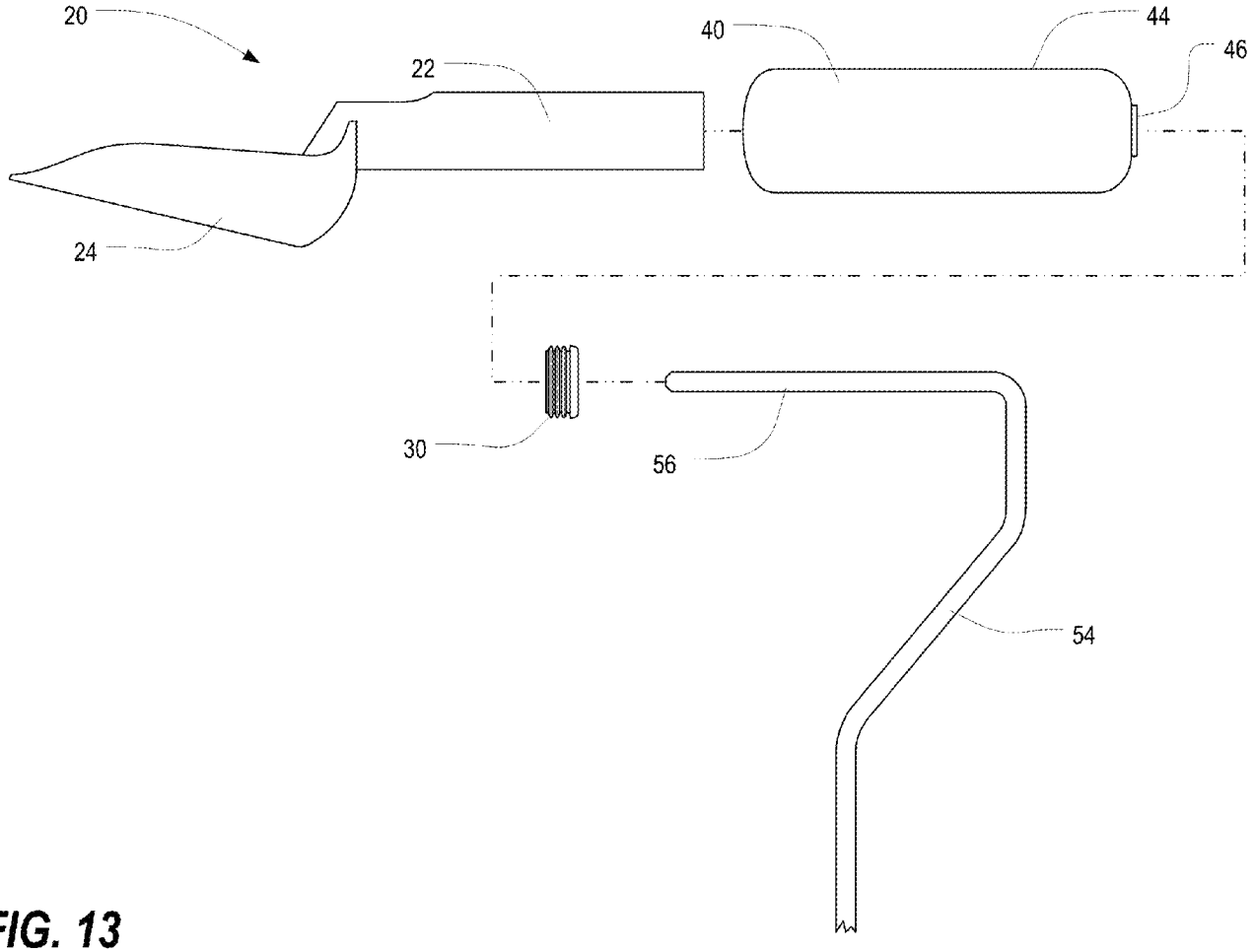
FIG. 13 is a fragmentary front exploded view of the gutter tool and holder of FIG. 12.
Figure 14:
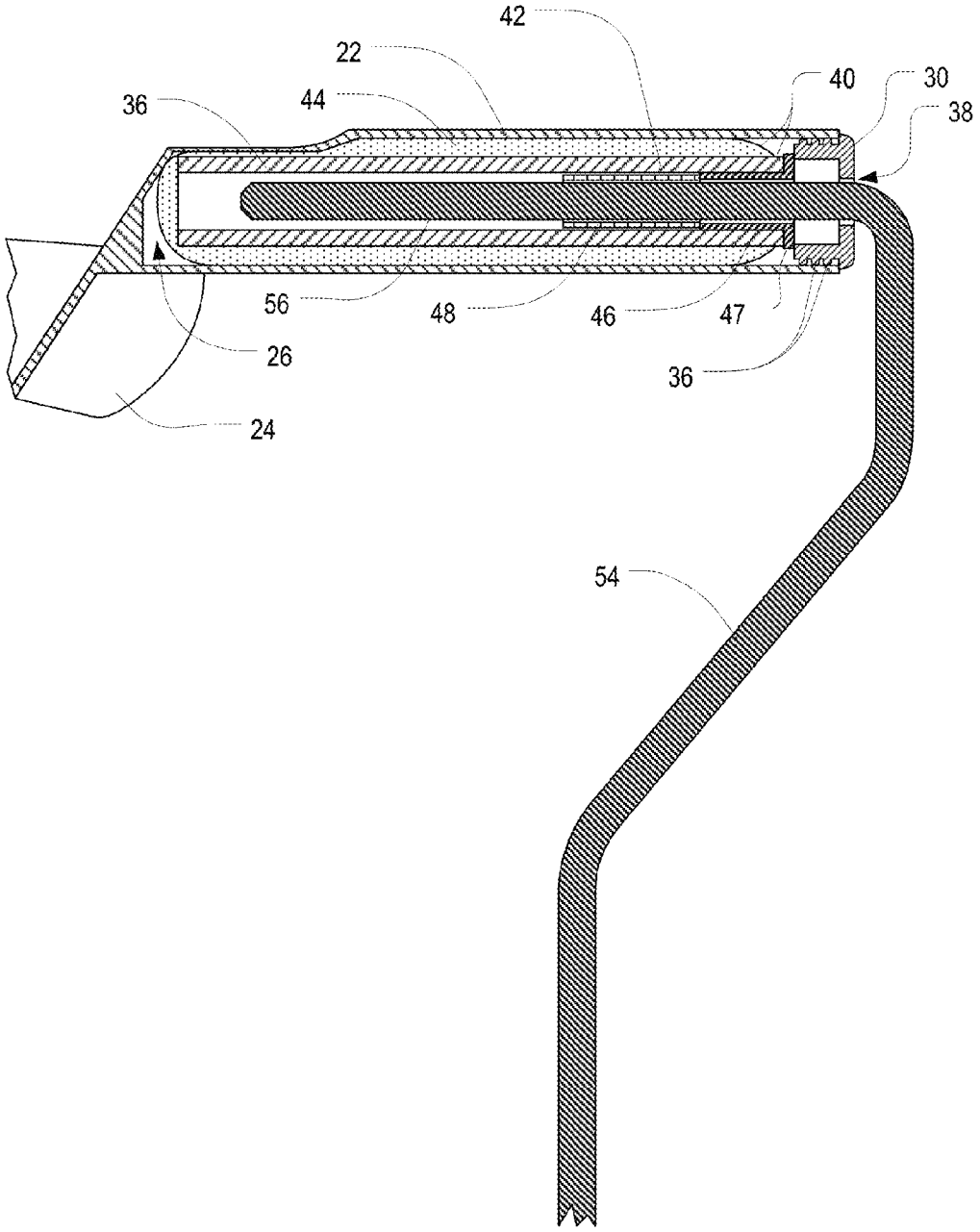
FIG. 14 is a fragmentary front cross-sectional view of the gutter tool and holder of FIG. 12.

One preferred mounting arrangement is shown in FIG. 13, which is a fragmentary front exploded view of the gutter tool 20 and holder 50 of FIG. 12, and FIG. 14, which is a fragmentary front cross-sectional view of the gutter tool 20 and holder 50 of FIG. 12. As collectively shown therein, the mounting arm 22 includes an internal cavity 26. A mounting assembly 40 is disposed within the cavity 26 and covered by an end cap 30. The tool interface (rod) 56 is inserted through the end cap and into the mounting assembly 40. As shown in FIG. 14, the mounting assembly 40 includes a cartridge 42 surrounded by a compressible layer 44 of soft material such as foam or low-density cloth. The mounting assembly 40 is effectively fixed within the internal cavity 26 of the mounting arm 22 by the compression of the compressible layer 44 between the cartridge and the interior walls of the mounting arm 22.

With further reference to FIG. 14, the cartridge 42 is preferably a hollow cylindrical tube and includes a fixed entry sleeve 46 and a floating internal sleeve 48 disposed therein. The fixed entry sleeve 46 is disposed at an open end of the cartridge 42 and has an internal diameter that is wide enough for the tool interface (rod) 56 to be slipped in easily. The fixed entry sleeve may include a wide flange 47 for a purpose of covering the end of the cartridge 42, a purpose of helping to retain the compressible layer 44 on the cartridge 42, a purpose of helping to retain the fixed entry sleeve 46 (and thus the floating internal sleeve 48) in the cartridge 42, and/or the like. The fixed entry sleeve 46 may be held in place via compression fitting, glue or other adhesive, or the like. The floating internal sleeve 48 is disposed, and is free to rotate, within the cartridge 42 and has an internal diameter that is narrower than that of the fixed entry sleeve 46. The floating internal sleeve 48 is preferably made of a plastic that permits the end of the tool interface (rod) 56 to be forced into its interior but which is then retained tightly thereon. By selecting the appropriate diameter and material, the mounting assembly 40 may be designed to be forced easily onto the end of the tool interface (rod) 56 such that the floating internal sleeve 48 is held in place on the rod 56 and such that the cartridge 42 and compressible layer 44 rotate around the floating internal sleeve 48. Because the gutter tool 20 is held in place on the mounting assembly 40 due to the compression of the compressible layer 44 within the mounting arm cavity 26, the gutter tool 20 itself is thus arranged to rotate around the tool interface (rod) 56.

Figure 15:
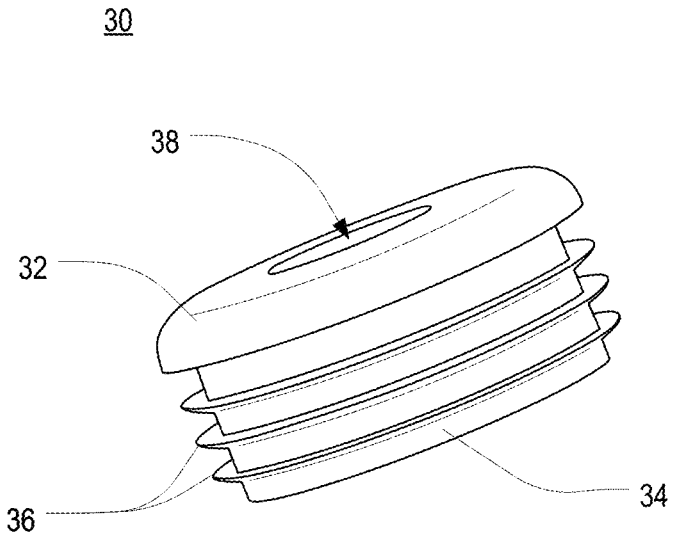
FIG. 15 is a perspective view of an end cap suitable for use in one or more preferred embodiments of the present invention.

To further assist in the retention of the mounting assembly 40 within the mounting arm cavity 26, to provide an improved appearance, to facilitate ease of insertion of the tool interface (rod) 56 into the cartridge 42, and/or the like, the end cap 30 is inserted into the open end of the mounting arm 22, thereby imprisoning the cartridge therein. In this regard, FIG. 15 is a perspective view of an end cap 30 suitable for use in one or more preferred embodiments of the present invention. As shown therein, the end cap 30 includes a cover 32 and an insert section 34 whose external periphery includes one or more ribs 36. An opening 38 penetrates the end cap cover 32 and is sized to permit the tool interface 56 (rod) to be inserted easily therethrough. The insert section 34 has a shape that corresponds to that of the cavity 26 and is sized to fit therein. The ribs 36 are preferably somewhat compressible so as to retain the insert section 34 within the cavity 26 via compression fit. A glue or similar material may be applied to further hold the end cap 30 in place in the end of the mounting arm 22.

It will be appreciated that other gutter tools 120,220,320 may utilize a similar interior mounting assembly 40, and that the various gutter tools 20,120,220,320 may be interchanged with each other. In some embodiments, a plurality of different gutter tools 20,120,220,320 are packaged and sold together.

Figure 16:
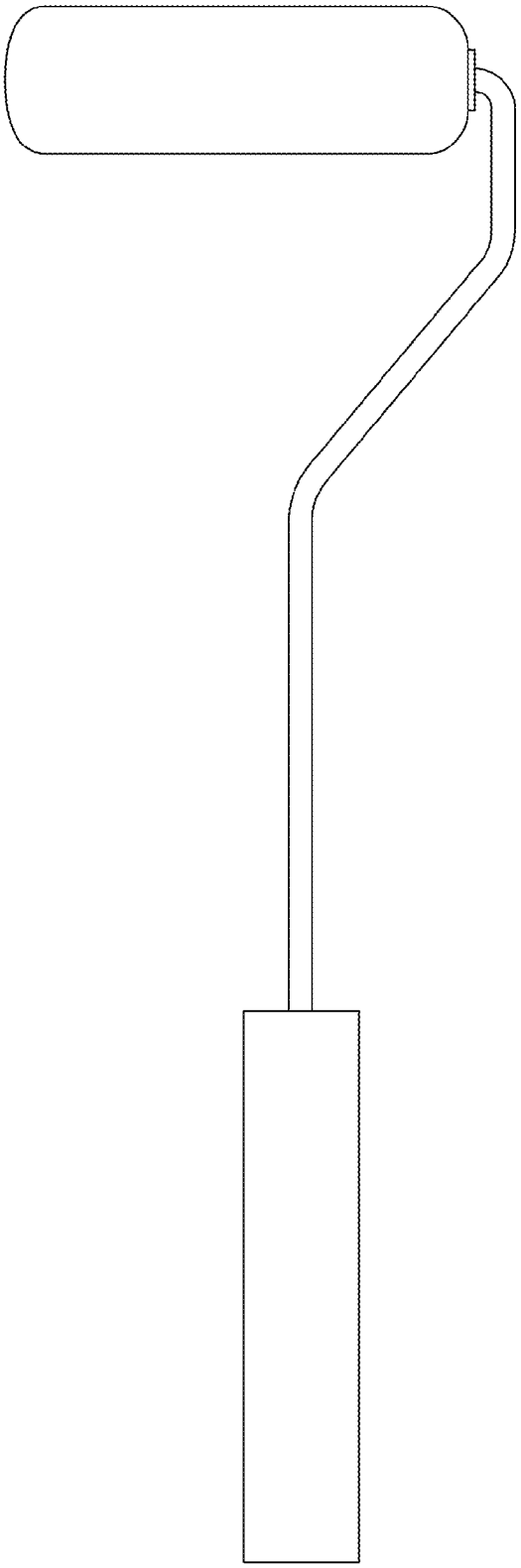
FIG. 16 is a front view of a paint roller cover installed on a paint roller holder.

It will be appreciated that in some embodiments, the holder 50 may be a conventional paint roller holder, the mounting assembly 40 may be a conventional paint roller cover, the extension assembly 60 may be a conventional extension assembly, and the gutter tool 20,120,220,320, may be a conventional garden tool. In this regard, FIG. 16 is a front view of a paint roller cover installed on a paint roller holder. Suitable paint roller holders and covers are available, for example, from SHUR-LINE, of Huntersville, N.C. and Quali-Tech Manufacturing Company of Torrance, Calif., and suitable garden tools are available from Fiskars Corporation of Finland.

Figure 17:
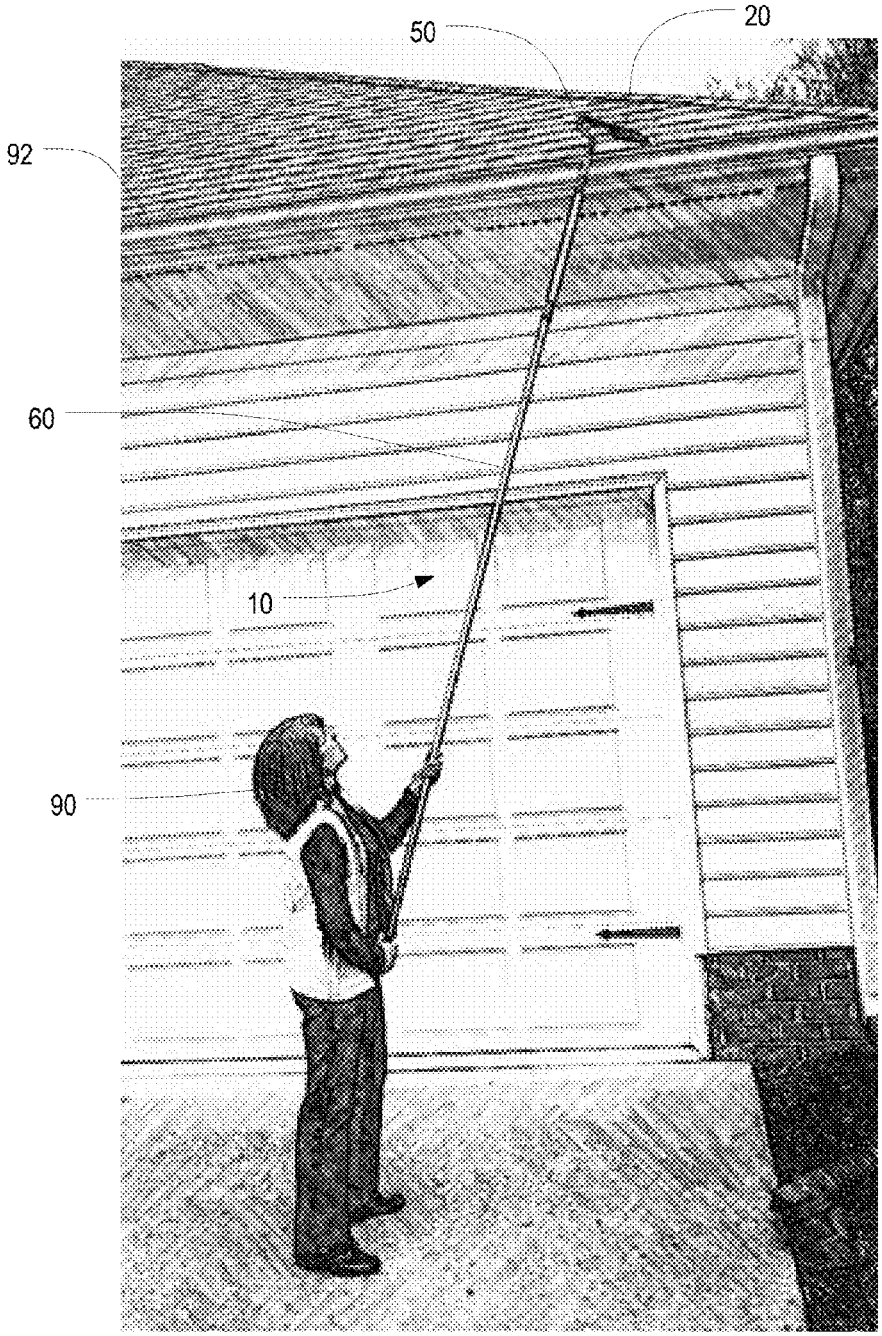
FIG. 17, which is an illustration of a person using the appliance of FIG. 1 to clean a gutter on a house in accordance with one or more preferred embodiments of the present invention.

To prepare the gutter cleaning appliance 10 for use, a particular gutter tool 20,120,220,320 is selected by a user 90, and the tool interface 56 (rod) is inserted into the cartridge 42 until it is held in place by the floating internal sleeve 48 thereof. Some amount of manually-applied force is necessary to accomplish such disposition. The assembled tool 20,120, 220,320 and holder 50 may then be used as a gutter cleaning appliance by themselves, or the extension assembly 60 may be attached to the proximal end of the holder 50 via the respective fittings 68,58. The appliance 10 may then be utilized as shown in FIG. 17, which is an illustration of a person 90 using the appliance 10 of FIG. 1 to clean a gutter 92 on a house in accordance with one or more preferred embodiments of the present invention. More particularly, the extension assembly 60 is extended to a desired length so as to position the selected gutter tool (in FIG. 17, the trowel tool 24 of FIG. 8) above and in line with the gutter 92. By placing the sharp tip of the trowel tool 24 into the gutter 92, the user 90 can easily determine the depth and magnitude of any debris in the gutter 92 while pushing and pulling the tool 24 along the base of the gutter 92, thereby ascertaining whether any cleaning is necessary. The user 90 can also inspect the opening at the downspout of the gutter 92 by sliding and pushing the tool 24 in that area. All of this can be accomplished from the ground, without need for visual sight or close inspection and, importantly, without need for the use of a ladder or riser apparatus.

In some situations, it has been found suitable to strike or pull the pointed edge of the trowel head along the bottom inside surface of gutter 92 in order to remove build-up and unwanted blockage. The additional, interchangeable gutter tools 120,220,320 have heads used for brushing, raking, washing and rinsing, and scrapping are useful for different levels of build-up, finishing the clean-up task, or the like. Once the desired tool 20,120,220,320 is selected, the entire gutter cleaning appliance 10, including the height of the extension assembly 60, can be quickly and easily prepared for the described cleaning action by simply screwing the holder 50 onto the fitting 68 on the upper end of the extension assembly 60 and sliding the chosen gutter cleaning tool 20,120,220,320 onto the tool interface 56 of the frame 54. This easy maneuver keeps the operator in control of any of an infinite number of desired positions to inspect a gutter 92 to ascertain if debris exists and to extract such material. Because there is no need to use a ladder (and the inherent time delays resulting from positioning the ladder, climbing up and down the ladder, and repeating the process many times), the process can be repeated on a regular basis rather than as a yearly endeavor, and/or in lieu of spending money to hire a professional gutter cleaner.

Advantageously, a mounting assembly 40 and tool interface 56 such as those described and illustrated herein, and particularly including the type used in a conventional paint roller, make it possible for a gutter tool 20,120,220,320 utilizing such a construction to rotate around the interface 56 with very little friction. In fact, any tool whose center of gravity is not collinear with the axis of the tool interface 56 and mounting assembly 40, such as the trowel tool 24, rake tool 124, or water sprayer tool 324, has a tendency to rotate around the interface 56 until the weight of the tool hangs downward, below the axis of the tool interface 56. As a result, there is less need for a user 90 to manipulate the appliance 10 in awkward or difficult orientations or positions because such tools may be relied upon to rotate into the proper orientation and position within the gutter 92.

The gutter cleaning appliance 10 may also be used to clean debris from the surface of the roof. More particularly, in the event that twigs, tree limbs or sticks are stranded and stuck upon one's roof, a person 90 can use the gutter cleaning appliance 10 may also, in some embodiments, be used as a hook, wherein the holder 50 is used with all gutter tools 20,120,220,320 removed and the tool interface 56 is bare. This hook action, using only the extension assembly 60 and holder 50, makes removal of foreign objects from thus stated roof a straightforward task.

Figure 18:
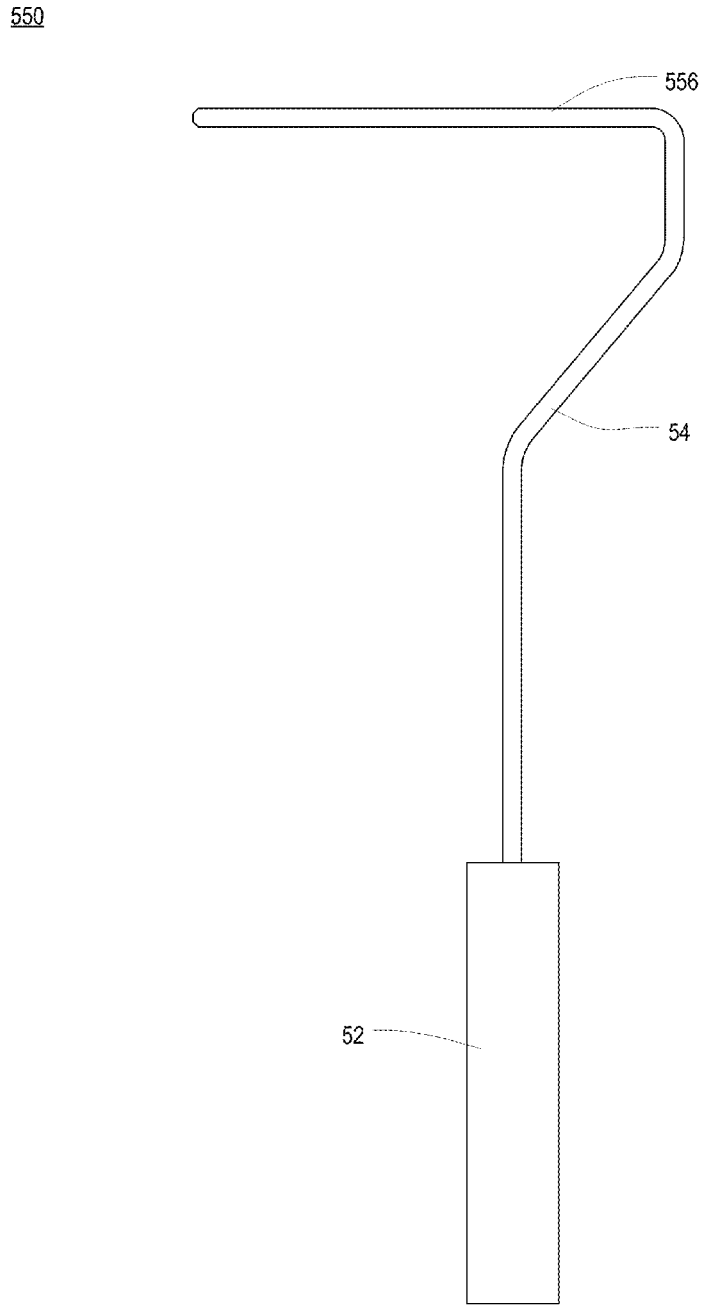
FIG. 18 is a front view of an alternative holder in accordance with another preferred embodiment of the present invention.
Figure 19:
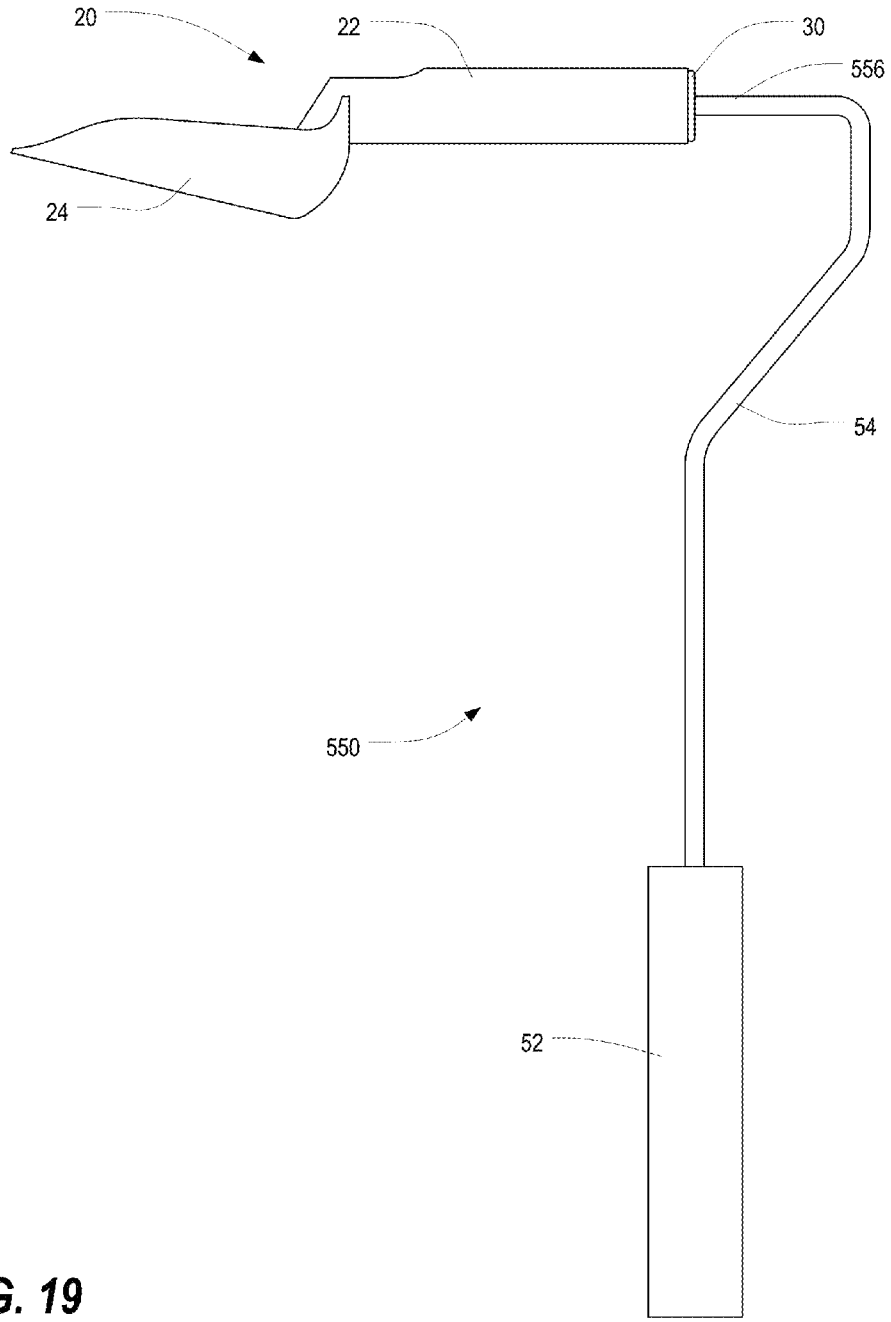
FIG. 19 is a front view of the holder of FIG. 18 with a tool mounted thereon.

Further variation and utility may be supplied by changing the length of the tool interface 56, or its position relative to the handle 52. In this regard, FIG. 18 is a front view of an alternative holder 550 in accordance with another preferred embodiment of the present invention. In this holder 550, the tool interface 556 is longer or extends further to the side. As shown in FIG. 19, which is a front view of the holder 550 of FIG. 18 with a tool 20 mounted thereon, the tool 20 may be disposed at a greater distance from the axis of the handle 52 (and although not shown, the extension assembly 60, which in turn allows a user 90 to insert the tool 20 deeper into a gutter 92 or otherwise reach into areas not accessible with a shorter tool displacement.

Advantageously, the interchangeable gutter cleaning appliance 10 enables a homeowner or other user 90 to clean gutters 92 without expensive, complicated, and hazardous contraptions, thus the present stated invention permits one person to quickly, safely and thoroughly clean hard-to-reach, overhead gutters without resorting to unsafe ladders or otherwise taking inconvenient risks. With the simplicity provided by the interchangeable gutter cleaning appliance 10 of the present invention, homeowners will be less inclined to ignore this significant chore. Furthermore, the result through regular maintenance helps ensure that water damage to home and property from overflowing gutters will be reduced and gutter repairs resulting from being overloaded with sediment will likewise be reduced. Still further, public health is promoted through the frequent removal of the breeding grounds for mosquitoes, snakes, rodents and other insects in shallow pools and soggy pockets otherwise produced by clogged gutters. The infinitely adjustable working components of the tool assure that virtually all gutters within reach of the infinite extension assembly heights can be properly cleaned and prepared for their intentional use.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. An interchangeable gutter cleaning appliance, comprising:

an extension assembly having a first fitting at a distal end;

a holder having a second fitting at its proximal end and a gutter tool interface at its distal end, wherein the second fitting is coupled to the first fitting of the extension assembly; and an interchangeable gutter tool;

wherein the interchangeable gutter tool is installed on the gutter tool interface by inserting the gutter tool interface into a mounting assembly disposed within the interchangeable gutter tool, and wherein the interchangeable gutter tool is removed from the gutter tool interface by removing the mounting assembly from the gutter tool interface;

wherein the interchangeable gutter tool includes a mounting arm in which the mounting assembly is disposed; and wherein the mounting assembly includes a cartridge surrounded by a compressible layer of soft material.

2. The interchangeable gutter cleaning appliance of claim 1, wherein the interchangeable gutter tool includes a plurality of interchangeable gutter tools, each including a different operational member, and no more than one of the plurality of interchangeable gutter tools being installed on the gutter tool interface at any one time.

3. The interchangeable gutter cleaning appliance of claim 2, wherein the plurality of interchangeable gutter tools include at least two of the following: a scoop, a rake, a brush, and a water sprayer.

4. The interchangeable gutter cleaning appliance of claim 2, wherein the plurality of interchangeable gutter tools are provided as a kit with the holder and the extension assembly.

5. The interchangeable gutter cleaning appliance of claim 1, wherein the cartridge includes a hollow cylindrical tube having a fixed entry sleeve and a floating internal sleeve disposed therein.

6. The interchangeable gutter cleaning appliance of claim 5, wherein the gutter tool interface includes a rod that is inserted into the fixed entry sleeve and the floating internal sleeve.

7. The interchangeable gutter cleaning appliance of claim 6, wherein the floating internal sleeve clamps around the rod, and wherein the hollow cylindrical tube, compressible layer of soft material, and mounting arm are free to rotate around the floating internal sleeve and rod.

8. The interchangeable gutter cleaning appliance of claim 6, wherein the rod is a forged metal rod.

9. The interchangeable gutter cleaning appliance of claim 1, wherein the compressible layer of soft material is a layer of foam.

10. The interchangeable gutter cleaning appliance of claim 1, wherein the interchangeable gutter tool includes a water sprayer supported by the mounting assembly.

11. The interchangeable gutter cleaning appliance of claim 10, wherein the water sprayer includes a nozzle and a hose fitting.

12. The interchangeable gutter cleaning appliance of claim 1, wherein the interchangeable gutter tool is free to rotate around the gutter tool interface when installed thereon.

13. The interchangeable gutter cleaning appliance of claim 12, wherein the gutter tool interface has a longitudinal axis, wherein the interchangeable gutter tool includes an operational member whose center of gravity is not collinear with the longitudinal axis of the gutter tool interface, and wherein the interchangeable gutter tool rotates such that it hangs below the gutter tool interface as the interchangeable gutter cleaning appliance is moved.

14. The interchangeable gutter cleaning appliance of claim 1, wherein the extension assembly includes a plurality of pull-out sections that may be manipulated relative to each other so as to adjust the overall length of the extension assembly and thus of the interchangeable gutter cleaning appliance.

15. The interchangeable gutter cleaning appliance of claim 14, wherein the first and second fittings are threaded fittings.

* * * * *